US006303284B1

(12) United States Patent
Lobo et al.

(10) Patent No.: US 6,303,284 B1
(45) Date of Patent: Oct. 16, 2001

(54) PROCESS FOR MANUFACTURE OF PHOTOGRAPHIC EMULSION

(75) Inventors: Lloyd A. Lobo, Webster; Sridhar Sadasivan, Rochester; Seshadri Jagannathan, Pittsford; Jerzy A. Budz, Fairport; David C. Gliottone, Rochester; John W. Boettcher, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/645,743

(22) Filed: Aug. 24, 2000

(51) Int. Cl.[7] ..... G03C 1/005; G03C 1/494

(52) U.S. Cl. ..... 430/569; 430/631; 430/449; 430/531; 430/567

(58) Field of Search ..... 430/569, 631, 430/567, 449, 531

(56) References Cited

U.S. PATENT DOCUMENTS

| | | | | |
|---|---|---|---|---|
| 3,501,304 | | 3/1970 | Koda et al. . | |
| 3,615,519 | | 10/1971 | Milton . | |
| 3,666,477 | | 5/1972 | Goffe . | |
| 3,706,562 | | 12/1972 | Herz et al. . | |
| 3,767,410 | * | 10/1973 | Brust et al. | 430/631 |
| 3,785,823 | | 1/1974 | Bigelow . | |
| 3,895,948 | | 7/1975 | Shiba et al. . | |
| 4,001,020 | | 1/1977 | Hayashi et al. . | |
| 5,147,771 | | 9/1992 | Tsaur et al. . | |
| 5,147,772 | | 9/1992 | Tsaur et al. . | |
| 5,147,773 | | 9/1992 | Tsaur et al. . | |
| 5,529,897 | * | 6/1996 | Adams et al. | 430/631 |
| 5,587,282 | | 12/1996 | Nakatsugawa et al. . | |
| 5,681,692 | | 10/1997 | Orem et al. . | |
| 5,959,024 | * | 9/1999 | Farwaha et al. | 524/716 |

FOREIGN PATENT DOCUMENTS 1 362 970 8/1974 (GB) .

OTHER PUBLICATIONS

Research Disclosure, Jan. 1995, Item 36929, titled "Antifoam Materials for Manufacturing Photographic Elements", pp. 29–30.

* cited by examiner

*Primary Examiner*—Geraldine Letscher
(74) *Attorney, Agent, or Firm*—Andrew J. Anderson

(57) ABSTRACT

A process for forming a silver halide photographic emulsion is disclosed comprising precipitating silver halide grains in an aqueous dispersing medium to which has been added silver and halide salt solutions while agitating the dispersing medium, wherein the precipitation is done in the presence of an antifoamant which comprises a hydrophobic group containing nonionic mono- or di-saccharide compound having an HLB number of between 2 and 12. The antifoamant material may be delivered to the aqueous dispersing medium as a small particle dispersion, made with the same peptizer used for manufacturing the emulsion or another stabilizer. A further embodiment of the invention is directed towards a silver halide photographic material comprising a support upon which is coated at least one light sensitive silver halide emulsion layer, comprising a silver halide emulsion precipitated in accordance with the described process.

20 Claims, No Drawings

PROCESS FOR MANUFACTURE OF PHOTOGRAPHIC EMULSION

FIELD OF THE INVENTION

This invention relates to the manufacture of silver halide photographic emulsions, and in particular to a process for the precipitation of silver halide grains in the presence of an antifoamant compound.

BACKGROUND OF THE INVENTION

Silver halide photographic emulsions are manufactured by introducing the reagents—typically aqueous solutions of silver nitrate and a halide salt—into a reactor, where the fluid is well mixed such as by using a rotary agitator. The high level of mixing is accomplished by high speed stirring and turbulence in the fluid. The nucleation and the growth process, and hence the properties of the photographic emulsion grains, are directly affected by the extent of mixing in the reactor. Therefore, in order to minimize variability in the photographic performance of the emulsion a high level of mixing is maintained throughout the time of the precipitation reaction. Additionally, emulsions are typically precipitated in the presence of a peptizer, which is usually gelatin, to maintain the colloidal stability of the particles. The use of high speed stirring results in the entrainment of air, which in the presence of gelatin leads to the formation of a stable foam. The volume of the foam continues to increase during the reaction and it is undesirable for several reasons. For one, the foam and the air bubbles interfere with the mixing conditions and can cause several dead reaction zones—leading to polydispersity in the properties of the resulting emulsion. The most serious problem of foam is that it occupies a significant volume in the reactor, which reduces the capacity of the reactor to produce a desired volume of the emulsion. Thus, foam generation directly affects productivity of a manufacturing operation.

In order to minimize problems encountered due to foam, some form of foam control is generally used. Chemical antifoamers that are added to the reactor can be classified as three distinct types: 1) defoamers that are added to break up a foam; 2) insoluble organic or inorganic materials; and 3) partially soluble or dispersible surface active materials.

Examples of defoamers of type 1) include alcohols such as butyl alcohol, octyl alcohol etc. The deficiency of these materials is that their antifoaming action is short term. That is, they are able to break the foam at the time of addition but cannot prevent subsequent formation of foam. Thus, they need to be added continuously resulting in large quantities of these materials associated with the emulsion. The presence of these materials can cause further problems in manufacturing operations where the emulsions are used, such as surface tension modification, vaporization. Thus, these materials are not generally desired.

Examples of insoluble organic materials of type 2) include silicone and paraffin oils. Frequently, these materials are made more effective by adding inorganic particles such as hydrophobic silica. These materials are quite effective at relatively low concentrations, and have a sustained antifoaming action. Also, these materials are non-volatile. This class of materials are disclosed in Research Disclosure 36929 (*Research Disclosure* is published by Kenneth Mason Publications, Ltd., Dudley House, 12 North Street, Emsworth, Hampshire P010 7DQ, ENGLAND). While these materials perform well as antifoamants in the reactor, they have catastrophic drawbacks in subsequent manufacturing operations, due to their interaction with other manufacturing hardware, such as UF membranes and filter membranes, which are a necessary part of the emulsion manufacturing process. Specifically, these insoluble materials foul ultrafiltration membranes which are used to deionize the emulsions, and they also plug filters. Their most serious problem is that they are prone to form coating defects during the coating of solutions on photographic support. Creation of a large concentration of coating defects can make a product unusable. The details of the way these materials act to defoam as well as broad range of examples of these kinds of materials are given in "Defoaming", P.R. Garrett Ed., Surfactant Science Series, Vol. 45, Marcel Dekker, NY 1993.

The third class of materials are partially soluble or dispersible surface active materials. These materials dissolve in the aqueous gelatin solution or disperse into very small drops, thereby minimizing the above mentioned problems. Examples of these materials include polyethylene oxide (EO)-polypropylene oxide (PO) block copolymers. U.S. Pat. Nos. 5,147,771, 5,147,772 and 5,147,773 disclose these general class of materials as grain growth modifiers to produce monodisperse emulsions. U.S. Pat. No. 5,587,282 discloses that among these materials, those having a PO content of 80% or more are effective as antifoamers. Other examples of these materials are disclosed in Res. Disc. 36929, as di and mono alkyl or alkenyl esters of polyethylene glycol having low water solubility. U.S. Pat. No. 5,587,282 also discloses polyalkylene oxide modified poly (dimethylsiloxane) fluids as antifoaming agents. All these examples fall under the general class of polyalkylene oxide containing organic materials with low solubility in water.

The general problem experienced by this class of materials is that, if the polyalkylene oxide content of the material is high, the potential of these materials to adsorb to the silver halide surfaces is high. This can result in grain growth modification as disclosed in U.S. Pat. Nos. 5,147,771, 5,147,772 and 5,147,773. While the use of growth modifiers for photographic emulsions may be useful in some instances, the growth modification property of this class of materials makes them unusable as general purpose antifoamants. In many instances, the growth modification process which results from the interaction of the antifoamant with silver halide emulsion can be severe enough to induce agglomeration as disclosed in U.S. Pat. No. 5,681,692. It is generally believed that this occurs because the polyalkylene oxide, specifically polyethylene oxide, part of the molecule has specific interactions with the silver halide surface. This results in its being adsorbed in preference to the usual peptizing agent that is used, thereby reducing the colloidal stability of the grains. However, if the polyalkylene oxide content of the material is low, the solubility or dispersibility of these materials in the gelatin solution is not adequate. This results in large drops of the antifoamant being present in the emulsion. The large drops can cause filtration problems as well as coating defects. In addition, the size of the drops and the severity of the problems they can cause, is variable, as the formation of these drops depends on the stirring conditions of the reactor. Another problem is that these materials, being hydrophobic, may adhere to the surfaces of the hardware of the reactor.

Thus, it is desirable to have a material that acts as an antifoamant which can be dispersed in a reproducible manner, in the reactor, without interacting with the surfaces of the silver halide grains and the manufacturing hardware, so as to manufacture emulsions that have superior photographic performance.

SUMMARY OF THE INVENTION

An object of this invention is to provide foam control during the manufacture of photographic silver halide emulsions, by using a chemical antifoamant.

Another object of this invention is for the chemical antifoamant to be added to the reactor in such a state so as to disperse it as fine droplets in a reproducible manner.

A further object of this invention is for the chemical antifoamant to have no observable interactions with the silver halide surface, in terms of the physical properties of the emulsion or photosensitive behavior of the emulsions.

Another further object of this invention is that the antifoamant material be effective at foam control, by using relatively small quantities with respect to the gelatin solution.

In accordance with one embodiment of the invention, in a process for forming a silver halide photographic emulsion comprising precipitating silver halide grains in an aqueous dispersing medium to which has been added silver and halide salt solutions while agitating the dispersing medium, the improvement is described wherein the precipitation is done in the presence of an antifoamant which comprises a hydrophobic group containing nonionic mono- or di-saccharide compound having an HLB number of between 2 and 12.

In a preferred embodiment, the antifoamant material is delivered to the aqueous dispersing medium as a small particle dispersion, made with the same peptizer used for manufacturing the emulsion or another stabilizer.

A further embodiment of the invention is directed towards a silver halide photographic material comprising a support upon which is coated at least one light sensitive silver halide emulsion layer, comprising a silver halide emulsion precipitated in accordance with the described process.

DETAILED DESCRIPTION OF THE INVENTION

The antifoamant compounds employed in accordance with the invention fall under a general class of surfactants/materials described as hydrophobically modified saccharides. Saccharide surfactants in general can be synthesized by hydrophobically modifying mono, di or polysaccharides. In general, a material that is expected to act as an antifoamant in silver halide photographic emulsion preparation is expected to displace gelatin (or other emulsion grain peptizer which may be used) as the stabilizer for foam bubbles. Furthermore, the stability imparted to the air bubbles by an adsorbed layer of the antifoamant should be low. This is usually accomplished by having the hydrophilic segment of the surfactant molecule to be small. Thus, useful antifoamants in accordance with the invention are restricted to hydrophobically modified mono and di-saccharides.

In accordance with one embodiment of the invention, hydrophobically modified mono saccharides of the following formula is employed:

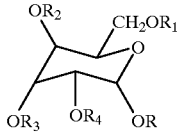

In the above formula, R is either H, an alkyl group with up to 8 carbon atoms, or —C(O)R'; $R_1$, $R_2$, $R_3$, and $R_4$ are each independently H or —C(O)R'; and each R' is independently an aliphatic, alicyclic, aryl or aralkyl group of up to 30 carbon atoms, with the proviso at least one of R, $R_1$, $R_2$, $R_3$ or $R_4$ is —C(O)R'. Preferably, at least one of R, $R_1$, $R_2$, $R_3$ or $R_4$ is —C(O)R' where R' is an aliphatic group of from 12 to 20 carbon atoms. In accordance with specific preferred embodiments, R is H or an alkyl group with up to 8 carbon atoms, and $R_1$ is C(O)R' where R' is an aliphatic group of from 10 to 30 carbon atoms and preferably from 12 to 20 carbon atoms.

In accordance with another embodiment of the invention, a hydrophobically modified di-saccharide of the following formula is employed:

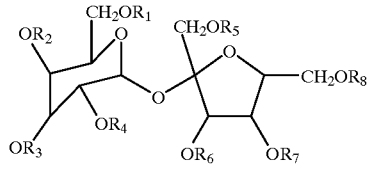

In the above formula, $R_1$, $R_2$, $R_3$, $R_4$, $R_5$, $R_6$, $R_7$, and $R_8$ are each independently H or —C(O)R'; and each R' is independently an aliphatic, alicyclic, aryl or aralkyl group of up to 30 carbon atoms, with the proviso at least one of $R_1$, $R_2$, $R_3$, $R_4$ $R_5$, $R_6$, $R_7$, or $R_8$ is —C(O)R'. Preferably, at least one of $R_1$, $R_2$, $R_3$, $R_4$ $R_5$, $R_6$, $R_7$, or $R_8$ is —C(O)R' where R' is an aliphatic group of from 10–30 carbon atoms. In accordance with specific preferred embodiments, $R_2$, $R_3$, $R_4$, $R_6$, and $R_7$, are H, and at least one of $R_1$, $R_5$, and $R_8$ is —C(O)R', more preferably where R' is an aliphatic group of from 10–30 carbon atoms.

The HLB number of a surface active material is essentially used to specify the nature of a oil/water dispersion that is formed in the presence of the surface active material. If the HLB is less than 7, the dispersed or the drop phase will be water. If the HLB is above 12 the dispersed phase is oil. It can also be used to predict its ability to form a foam, where oil is replaced by air. In a congruent manner, if the surface active material has an HLB number 12 or greater, the higher is its probability of stabilizing a foam. In photographic system, the antifoamant, which is a surface active material, is expected to completely displace and replace gelatin at the surface of the air bubbles. Additionally, the new adsorbed layer should not be a stabilizer for foams. Thus, the requirement that the antifoamant have a HLB number less than 12. On the other hand, if the HLB is too low, the solubility of the surface active material in the aqueous phase will be too low to provide an effective active concentration, in the aqueous phase, for the antifoamant to work. Also, if the solubility is low, the antifoamant will be dispersed as large drops, which can create other problems in the manufacturing operations.

Unmodified mono- and di-saccharides are highly water soluble and will have high HLB values assigned to their units (e.g., >30). In accordance with the invention, the hydrophobicity is modified such that the HLB number of the antifoam is between 2 and 12. The degree of modification (esterification) in the above mono- and di-saccharide formulas and the length of the carbon chain(s) determines the hydrophobicity of the modified saccharide. The invention is not limited to modified glucose and sucrose compounds, as mono, di and higher esters of other mono- and di-saccharides can also be used as antifoamants, provided they fall within the specified HLB range of 2 to 12. In accordance with preferred embodiments of the invention, the modified saccharide antifoamant compound preferably has an HLB of from 5 to 12.

The HLB of surface active materials can be measured or calculated. There arc several methods of measuring HLB. These methods are listed in "Nonionic Surfactants", Ed. M.

Schick, "Surfactant Science Series", Vol. 1, Marcel Deker Inc., New York, 1967. A technique using Gas Chromatography is commonly used, where the surface active material is deposited on an acid washed chromatographic resin—Chromosorb P from an acetone solution. A column, 3 ft long and ¼ inch in diameter is prepared. With the column maintained at 80° C., a 3.0 μl sample of a standard 1:1 ethanol/hexane solution is injected into the instrument. The retention times of each peak are measured and the ratio P of the retention time of ethanol to hexane is calculated. P is directly related to the HLB value of the surface active material as reported by Becher and Birkmeier, J. American Oil Chemists' Soc., vol 41, pg. 8, 1964.

Examples of commercially available modified saccharide surfactant materials for use in accordance with the invention include Glucate DO and Glucate SS (modified methyl glucosides available from Amerchol), Mazon 40A (hydrophobically modified alkyl glucoside available from PPG) and Crodesta Sucrose Diesters F10, F50, and F-110 (available from Croda).

Precipitation of silver halide emulsions in a dispersing medium for photographic applications is generally carried out by a single jet addition of an aqueous solution of silver nitrate or a double jet addition of an aqueous solution of silver nitrate and an aqueous solution of alkali halide to a reactor containing water, gelatin and alkali halide, typically maintained at a temperature ranging from 40–80° C., with vigorous mixing. The molar concentrations of the silver nitrate and the alkali halide solutions are typically greater than 0.5 and the gelatin concentration in the reactor at the beginning of the precipitation process generally range from 0.2–6% by weight. Phenomenologically, the precipitation process may be separated into the following segments.

Nucleation: This is typically carried out by the single jet addition of silver nitrate solutions or by the double jet addition of silver nitrate and alkali halide solutions for a short period of time into a reactor containing alkali halide, gelatin and water. The gelatin concentration may range from 0–6% by weight.

Ripening: The number silver halide crystals generated from the nucleation step is reduced to a desired number by Ostwald ripening, by increasing their solubility in the reactor. Increase in the reactor temperature, addition of a silver ion chelating agent, etc. are typical procedures for accelerating the ripening process.

Addition of more gelatin: The crystals obtained from the ripening step are stabilized by adding more gelatin. The concentration of gelatin in the reactor at the end of this step is typically greater than 1% by weight.

Growth: The crystals obtained from the previous step are grown to a desired size by a single jet silver nitrate addition process or a double jet silver nitrate and alkali halide addition process or the addition of preformed silver halide seeds or a combination of all three processes. At the end of the growth process the gelatin concentration in the reactor is typically less than 6% by weight and the ionic strength of the reactor is very high, close to saturation.

The peptizer used in the manufacture of emulsions is typically gelatin. This may be gelatin in its natural state or a modified gelatin such as acetylated gelatin, phthalated gelatin, oxidized gelatin, etc. Gelatin may be base-processed, such as lime-processed gelatin, or may be acid-processed, such as acid processed ossein gelatin or acid processed pig skin gelatin. It is specifically contemplated to use gelatin containing a low level of methionine (e.g., oxidized gelatin containing less than 30 μmoles of methionine per gram) as a peptizer in the process of the invention. Additionally, other known silver halide grain peptizers may be used, such as synthetic polymeric compounds and starch compounds.

The antifoamants used in accordance with the present invention can be added at any point of the emulsion manufacturing process depending on the need for foam control. In general, it is preferred that the total amount of modified saccharide added to the dispersing medium as antifoamant is from 1 ppm (part per million) to 1%, more preferably 0.002% to 0.1% of the total weight of the emulsion that is made.

As outlined above there are several sequential steps in the precipitation step for emulsions. During the formation of nuclei, ripening and the subsequent growth of the nuclei, it is important to eliminate concentration gradients of the reactants, which is accomplished by agitation. A stable foam is formed by the entrained air which is stabilized by the gelatin. The antifoam can be added prior to introduction of reagents or during the growth process, depending on the amount of gelatin that is present at different points of the reaction. After the reaction, the emulsion is subsequently desalted and concentrated. This can be accomplished by several methods—by membrane separation technologies like ultrafiltration or by electrodialysis or by phase separation techniques using acidic or alkaline sedimenting agents. In the membrane separation processes, the emulsion is pumped through restricted passage ways, resulting in cavitation which causes a foam build up. In phase separation processes, foam or entrained air from the reaction step hinders the separation step. Thus, the antifoam may be added, or its concentration increased, in the step for desalting and concentration. During the chemical sensitizing step, as in the reaction step, agitation of the fluid is desired to minimize concentration gradients of the sensitizers as they are added. Thus, antifoams are needed for the same reason that they are needed during the reaction step.

In a preferred embodiment, the antifoam is first made into a small particle dispersion prior to its being added to the emulsion dispersing medium. The small particle dispersion can be prepared as follows: The liquid antifoamant is mixed with an aqueous solution containing one or more stabilizers. The concentration of antifoamant in the dispersion may be between 0.1 and 50 weight percent. The most common stabilizers are surfactants which may be cationic, anionic, zwitterionic or non-ionic. Ratios of surfactant to the antifoamant typically are in the range of 0.5 to 25 wt. % for forming small particle dispersions. Particularly preferred surfactants which may be employed in the present invention include an alkali metal salt of an alkarylene sulfonic acid, such as the sodium salt of dodecyl benzene sulfonic acid, the sodium salt of isopropylnaphthalene sulfonic acid or a mixture of sodium salts of mono, di, and tri isopropylnaphthalen sulfonic acid; an alkali metal salt of an alkyl sulfuric acid, such as sodium dodecyl sulfate; or an alkali metal salt of an alkyl sulfosuccinate, such as sodium bis (2-ethylhexyl) succinic sulfonate. In addition to the surfactant other hydrophilic high molecular weight stabilizers may be present. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly (vinylacetate-co-vinylalcohol), hydroxyethyl cellulose, poly (acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used. Among these it is preferred to use gelatin, which is the typical peptizer used to make emulsions. The amount of gelatin may preferably vary between 1% to 25% by weight of the aqueous solution, and is typically present at 10% to 1000% relative to the amount of the antifoamant in the dispersion.

In order to prepare the dispersion, the mixture of the aqueous phase and the antifoam is then passed through a mechanical mixing device suitable for high-shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The dispersion particles generally have an average particle size from about 0.02 to 100 microns, preferably less than 20 microns. The dispersion of the antifoam can be made into a gel by lowering its temperature to below 20° C. and then stored at temperatures between 0 and 10° C. In order to enhance the shelf life and prevent attack by biological agents, a suitable biocide such as KATHON (5-chloro-2-methyl-4-isothiazolin-3-one and 2-methyl-4-isothiazolin-3-one) may be added at the required concentration, which for KATHON is between 5 and 100 ppm based on the weight of the dispersion.

The antifoamant disclosed in this patent does not interact with silver halide emulsions of any halide composition and hence can be used as antifoam ants in the precipitation of any silver halide emulsions in an aqueous gelatin medium. Examples of silver halide composition include (but are not limited to) silver bromide, silver chloride, silver iodide, silver bromo iodide, silver bromo chloride, silver bromo iodo chloride and silver chloro iodide, the ratio of the various halides in the emulsion ranging from 0–100%. The halide composition refers to the composition in the individual grains and the emulsion can be a mixture of grains with varying compositions. The gelatin used in the precipitation process include (but is not limited to) all combinations of oxidized or non-oxidized, chemically modified or non-chemically modified, and deionized or non-deionized gelatin of any molecular weight. The extent of oxidation, chemical modification and deionization can range individually from 0–100% and the overall gelatin content (molecular weight, extent of oxidation and chemical modification) may be polydisperse. The physical characteristics of the silver halide emulsion, such as morphology may be (but is not limited to) 3-dimensional (e.g., cubic, octahedral, cubo-octahedral) or 2-dimensional (e.g., tabular grains with {111} or {100} major surfaces) or a combination of various morphologies in any ratio and the size of these emulsions may range from 0.01 $\mu$m to 10 $\mu$m or greater. The size dispersity can range from less than 5% to greater than 50%. Any combination of silver halide composition, morphology, size and gelatin can be manufactured using these antifoamants.

We have found several advantages by using antifoamants comprising hydrophobically modified saccharide compounds in accordance with the present invention.

1) It is excellent at preventing foam and breaking up a foam that is formed in any solution that contains gelatin. It is also effective over a wide temperature range, which can be encountered during emulsion manufacture.

2) It does not interact with the surface of the silver halide grains, even in the most susceptible emulsion formulas, thereby avoiding such deleterious effects like clumping of the emulsion grain, or undesired grain growth modification.

3) It does not foul the membranes used in desalting and concentrating emulsions.

4) It does not plug filters used in the process of coating photographic elements using these emulsions.

5) It can be made into a dispersion that allows instantaneous and uniform dispersal of the antifoamant.

6) Enhanced photographic performance in the form of improved keeping.

The present invention is described in more detail by means of the following examples, which, however, are not intended to restrict the scope of the present invention.

EXAMPLES

Description of antifoams

The antifoams used in the following examples are listed below:

A1—dioleate ester of methyl glucoside. Trade name is Glucate DO manufactured by Amerchol. HLB=5.0

A2—methyl glucose sesquistearate. Trade name is Glucate SS manufactured by Amerchol. HLB=6.0

A3—A mixture of modified alkyl glucosides. Trade name is Mazon 40A, manufactured by PPG. HLB=8.0

A4—Sucrose distearate. Trade name Crodesta F10 manufactured by Croda. HLB=3.0

A5—Sucrose distearate/ sucrose monostearate 70/30. Trade name Crodesta F50 manufactured by Croda. HLB=6.5

A6—comparative antifoamant—propylene oxide/ ethylene oxide tri-block polymer. Trade name Tetronic 90R4 manufactured by BASF. HLB=7.0

A7—comparative antifoamant—Dioleate ester of polyethylene glycol, 9-10EO (Emerest 2648, manufactured by Henkel). HLB=8.8

A8—comparative antifoamant—Dioleate ester of polyethylene glycol, 4-5EO, (Mapeg 200 DO, manufactured by BASF). HLB=5.0

In order to compare the performance of the different antifoams, several tests were performed as described below:

Antifoaming Efficacy Test (a):300 ml of a gelatin solution was taken in a jacketed 1 L volumetric cylinder. The required amount of the antifoam dispersion was added to achieve the desired concentration of the active ingredient in the gelatin solution. The temperature of the jacket was maintained at the desired temperature. Nitrogen was bubbled from the bottom of the cylinder at rate of 800 ml/min, through a diffuser stone. The final steady state height of the foam generated is noted down. If the height exceeded the volume of the cylinder (1 L), the gas generation was ceased, and the time for the foam to decay to half its volume (½ L) was measured.

Antifoaming Efficacy Test (b): 10 ml of a 2% gelatin solution, containing 100 ppm of the antifoam, was transferred to a 1 cm diameter measuring cylinder. The cylinder was shaken manually, till the volume of the foam generated does not change. The volume of the foam and liquid is noted as soon as the shaking is stopped.

Dispersibility: The dispersibility of an antifoam is evaluated by adding the antifoam, in the amount appropriate for antifoaming, to a 2 Kg gelatin solution, at 40° C., which is gently stirred. Visual observations of the ability to disperse are made.

Plugging of Filters and Interaction with silver iodide emulsions: The propensity of the antifoam to plug filters and the propensity to interact with silver iodide emulsion was measured by a filtration technique. The emulsion was precipitated in a gelatin which was oxidized to reduce the methionine content of the gelatin to less than 30 μmole per gram of emulsion. The size of the grains was 0.06 μm. The combination of a silver iodide emulsion, small grain size and low methionine content of the gelatin, makes the emulsion sensitive to destabilization. Thus, if the antifoam has any interaction with the silver iodide emulsion, it destabilizes the emulsion which then forms aggregates or clumps in the gelatin medium. The extent of aggregation or clumping can be judged from the filtration characteristics of the emulsion with the antifoam. The Filtration Test Unit consists of a temperature controlled, pressurizable 3 L reservoir with a 47 mm diameter filter holder connected to the bottom outlet. The filter holder is loaded with a 47 mm diameter disk of the chosen filter medium. A fiberglass medium of average pore diameter 2 to 4 μm is used. The reservoir is filled with 300 grams of the emulsion maintained at 40° C. for 30 minutes with the antifoam. The top is capped and the unit is pressurized to 1.5 psig by a pressure regulator. The filtrate is collected in a beaker on an electronic balance. The output from the balance is fed into a computer with a software program that collects cumulative filtrate weight as a function of time. The collected data has been analyzed using a Standard Blocking Model as described by Hermans and Bredee in J.Soc. Chem. Ind., 55T, 1(1936). According to this model, inverse filtration rate is plotted against time. The slope indicates the plugging of the filter. The higher the slope, higher is the degree of plugging. The propensity of the antifoams themselves to plug filters is given by the slope obtained when filtering a gelatin solution containing antifoams. The propensity of the antifoam to interact with an emulsion is given by:

$$\begin{bmatrix}\text{slope obtained by}\\ \text{filtering an emulsion}\\ \text{with antifoam}\end{bmatrix} - \begin{bmatrix}\text{slope obtained by filtering}\\ \text{a gelatin solution with}\\ \text{antifoam}\end{bmatrix}$$

This difference is called the emulsion interaction parameter. Hence, the filtration experiments provide two distinct pieces of information: (1) the propensity of the antifoam to plug filters and (2) the propensity to interact with AgI emulsions.

EXAMPLE 1

Varying levels of A1 and the comparative antifoamant A6 (a known efficient antifoamer) were tested for antifoaming efficiency by test (a) described above. The experiments were carried out at 60° C. The results from the foam test are shown in Table 1.

TABLE 1

| Antifoamant | Gelatin conc. | Antifoam conc. (ppm) | Maximum foam volume | Time for foam to decay to half volume |
|---|---|---|---|---|
| None | 2% | — | 1000 | 17 min |
| A6 (comp) | 2% | 50 | 350 | — |
| A6 (comp) | 2% | 100 | 350 | — |
| A1 (inv.) | 2% | 50 | 1000 | 34 sec |
| A1 (inv.) | 2% | 100 | 825 | — |
| A1 (inv.) | 2% | 200 | 425 | — |
| None | 6% | — | 1000 | 21 mm |
| A6 (comp) | 6% | 50 | 550 | — |
| A6 (comp) | 6% | 100 | 375 | — |

TABLE 1-continued

| Antifoamant | Gelatin conc. | Antifoam conc. (ppm) | Maximum foam volume | Time for foam to decay to half volume |
|---|---|---|---|---|
| A1 (inv) | 6% | 50 | 1000 | 2½ min |
| A1 (inv) | 6% | 100 | 1000 | 47 sec |

In addition to the antifoaming efficiency, the filter plugging test was also carried out to determine the relative propensity of antifoamant A1 of the invention to interact with silver halide emulsions and plug filters in comparison to antifoamants A6, A7, and A8. The results are shown in Table 2:

TABLE 2

| Antifoam | Concentration (ppm) | Slope (from gelatin solution) × 1000 | Slope (from Emulsion) × 1000 | Difference in Slope (Emulsion Interaction Parameter) × 1000 |
|---|---|---|---|---|
| A6 (comp) | 25 | | Filter plugged severely | Not measurable |
| A7 (comp) | 150 | 0.147 | 5.29 | 5.143 |
| A8 (comp) | 100 | 3.51 | 3.17 | 0.34 |
| A8 (comp) | 200 | 6.9 | 7.68 | 0.78 |
| A1 (inv) | 300 | 3.22 | 3.21 | 0.01 |

The antifoam of the present invention is an adequate antifoamer in the range of gelatin concentration of interest, although it is slightly less efficient than the comparison antifoamant A6. However, due to the absence of ethylene oxide groups, it does not interact with the emulsion, unlike the comparison antifoamants A6 and A7. Based on the emulsion interaction parameter, the high value of the slope for A7 shows that it has a high propensity to interact with the silver iodide emulsion and cause clumping, whereas the invention antifoamant A1 has a very low slope, indicating a low propensity for interaction with the silver iodide emulsion. Comparison antifoamant A6 in fact completely destabilized the emulsion, rendering it unfilterable. The inventive antifoamant A1 also has much smaller interaction with the filter medium than comparative example A8, as evidenced by the smaller value of the slope obtained when filtering a gelatin solution. Thus, the invention A1 is superior in performance to the comparative antifoams, A6, A7 and A8.

EXAMPLE 2

A small particle dispersion of antifoamant Al was made as follows: 10 grams of Type IV gelatin, 1 gram of an anionic surfactant (mixture of di and tri isopropyl naphthalene sulfonate) and 169 grams water were soaked overnight, then melted at 45° C. 20 grams of Al was added. The mixture was then subjected to stirring by a rotor-stator mixer at 7000 rpm for 15 minutes. The particle size of the mixture was measured using a coulter counter. The volume average particle size measured by the instrument was 11.5 μm. The mixture was then chilled at 10° C. to set up as a gel.

Antifoaming efficiency tests were carried out using test (a) with the dispersion of A1 as well as with A1 in its native state. The antifoamant, in either form, was added to a 2% gelatin solution, at 40° C., which was being stirred gently. The ability of the antifoamant to disperse in the gelatin solution, was observed. The concentration of active antifoamant added was 100 ppm based on the weight of the whole solution. After mixing in the antifoamant, the mixture was used in test (a) to determine the antifoaming efficiency. The test was carried out at 60° C. The results are shown in Table 3:

TABLE 3

| Antifoamant | Dispersibility in gelatin solution | Maximum foam volume |
|---|---|---|
| A1 (native state) | Poor - large drops observed | 825 |
| A1 (as a dispersion) | Good - no visible drops | 800 |

The above data demonstrates the antifoamant A1 can be made into a small particle dispersion in order to improve the dispersibility of the antifoam, without substantially altering its antifoaming efficiency.

EXAMPLE 3

The antifoaming efficiency of materials A1 through A5 were evaluated using test (b), and the results are shown in Table 4:

TABLE 4

| Antifoam | Maximum volume of foam + liquid |
|---|---|
| None | 21 ml - broke over a period of an hour |
| A1 | 13 ml - foam broke over 1 minute |
| A2 | similar to A1 |
| A3 | 15 ml - foam breaks over 2–3 minutes |
| A4 | 12 ml - foam breaks quickly |
| A5 | 15 ml - foam breaks over 2–3 minutes |

As seen from the data of Table 4, the general class of hydrophobically modified saccharides perform well as antifoams.

EXAMPLE 4

Preparation of Emulsion E1 (comparison): To a reactor incorporating a stirring device as disclosed in Research Disclosure, Item 38213, and containing 8.756 kg of distilled water, 25 mg of p-glutaramidophenyl disulfide and 251 g of bone gelatin and 1.59 g of antifoam A7, were added 291 g of 3.8 M sodium chloride salt solution such that the mixture was maintained at a pCl of about 1.05 at approximately 68° C. To this were added 1.9 of 1,8-dihydroxy-3,6-dithiaoctane approximately 30 seconds before commencing introduction of silver and chloride salt solutions. Aqueous solutions of about 3.7 M silver nitrate and about 3.8 M sodium chloride were then added by conventional controlled double-jet addition at a constant silver nitrate flow rate of about 74 mL/min for about 39 minutes while maintaining pCl constant at about 1.05. Both the silver and sodium salt solution pumps were then turned off and about 0.8 M potassium iodide solution was added to the stirred reaction mixture over about 30 seconds at a constant flow rate of about 62.9 mL/min. The resultant iodochloride emulsion was then grown further by conventional controlled double-jet addition for about 4.5 minutes by resumed addition of silver and sodium salt solutions at about 74 mL/min at a pCl of about 1.05. In addition, cesium pentachloronitrosylosmate was added at approximately 4 to 70% into the precipitation and potassium hexacyanoruthenate at 75–80%. A silver iodochloride emulsion was thus prepared with 0.2 mole % iodide located at 90% of total grain volume. Cubic edge length was 0.64 $\mu$m.

Preparation of emulsion E2 (invention): Emulsion E2 was prepared in an identical manner as E1, except that instead of antifoam A7, antifoamant A1 in the amount of 1.6 g was added to the reactor.

A portion of each of these silver iodochloride emulsions E1 and E2 were optimally sensitized by the addition of p-glutaramidophenyl disulfide followed by the addition of a colloidal suspension of aurous sulfide and heat ramped to 60° C. during which time blue sensitizing dye (Dye-1), potassium hexachloroiridate, Lippmann bromide, and 1-(3-acctamidophenyl)-5-mercaptotetrazole were added.

Dye-1

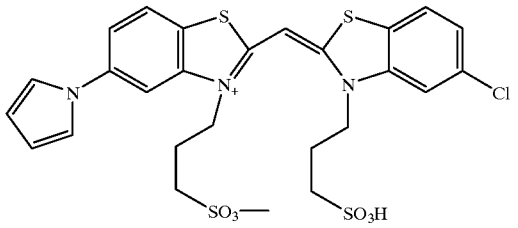

Blue sensitized emulsions E1 and E2 were coated on paper support at 19.5 mg silver per square foot and yellow dye forming coupler Y-1 at 50 mg per square foot. The coatings were overcoated with gelatin layer and the entire coating was hardened with bis(vinylsulfonylmethyl)ether.

Y-1

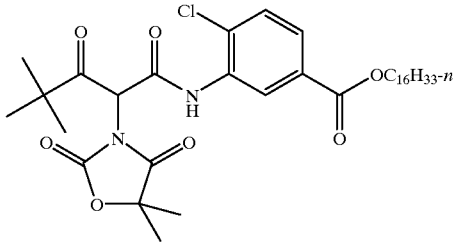

Single layer samples were exposed for 0.1 second to simulate exposure through a color negative film. 0–3.0 density step tablet was used and the source of white light was a Kodak Model 1B sensitometer with a color temperature of 3000° K. and with a combination of the appropriate filters. The exposed coatings were processed using KodakTM Ektacolor RA-4 processing.

Relative log speed was measured at 0.8 absolute density at $1\frac{1}{10}^{th}$ second exposure time. Dmin was measured at the unexposed part of the strip. In addition, Dmin growth (with the comparison sample designated as 100% growth) on 2 week keeping stability test (at 49° C. (120° F.) and Relative Humidity at 50%) were measured. Significant reduction in Dmin keeping is observed as indicated in Table 5.

TABLE 5

Photographic evaluation of the antifoamant

| Emulsion | Antifoamant | Speed | Dmin | % Dmin growth on keeping |
|---|---|---|---|---|
| E1 Comparison | A7 | 100.0 | 0.061 | 100 |
| E2 Invention | A1 | 100.1 | 0.062 | 79 |

The invention has been described in detail with particular reference to certain preferred embodiments thereof, but it will be understood that variations and modifications can be effected within the spirit and scope of the invention.

What is claimed is:

1. In a process for forming a silver halide photographic emulsion comprising precipitating silver halide grains in an aqueous dispersing medium to which has been added silver and halide salt solutions while agitating the dispersing medium, the improvement wherein the precipitation is done in the presence of an antifoamant which comprises a hydrophobic group containing nonionic mono- or di-saccharide compound having an HLB number of between 2 and 12.

2. A process according to claim 1, wherein the antifoamant comprises a hydrophobically modified mono saccharide of the formula:

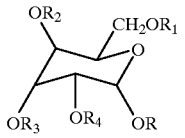

wherein

R is either H, an alkyl group with up to 8 carbon atoms, or —C(O)R';

$R_1$, $R_2$, $R_3$, and $R_4$ are each independently H or —C(O)R'; and each R' is independently an aliphatic, alicyclic, aryl or aralkyl group of up to 30 carbon atoms, with the proviso at least one of R,$R_1$, $R_2$, $R_3$ or $R_4$ is —C(O)R'.

3. A process according to claim 2, wherein R is H or an alkyl group with up to 8 carbon atoms.

4. A process according to claim 3, wherein $R_1$ is —C(O)R' and R' is an aliphatic group containing 10 to 30 carbon atoms.

5. A process according to claim 2, wherein at least one of R, $R_1$, $R_2$, $R_3$ or $R_4$ is —C(O)R' where R' is an aliphatic group of from 12 to 20 carbon atoms.

6. A process according to claim 2, wherein the antifoamant comprises a dioleate ester of methyl glucoside.

7. A process according to claim 2, wherein the antifoamant comprises methyl glucose sesquistearate.

8. A process according to claim 1, wherein the antifoamant comprises a hydrophobically modified di-saccharide of the formula:

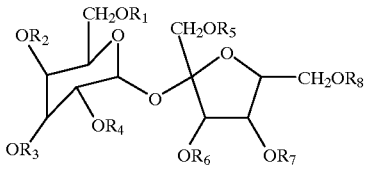

wherein $R_1$, $R_2$, $R_3$, $R_4$, $R_5$, $R_6$, $R_7$ and $R_8$ are each independently H or —C(O)R'; and each R' is independently an aliphatic, alicyclic, aryl or aralkyl group of up to 30 carbon atoms, with the proviso at least one of $R_1$, $R_2$, $R_3$, $R_4$ $R_5$, $R_6$, $R_7$ or $R_8$ is —C(O)R'.

9. A process according to claim 8, wherein $R_2$, $R_3$, $R_4$, $R_6$, and $R_7$, are H.

10. A process according to claim 9, wherein at least one of $R_1$, $R_5$, and $R_8$ is —C(O)R' where R' is an aliphatic group of from 10–30 carbon atoms.

11. A process according to claim 8, wherein at least one of $R_1$, $R_2$, $R_3$, $R_4$ $R_5$, $R_6$, $R_7$, or $R_8$ is —C(O)R' where R' is an aliphatic group of from 10–30 carbon atoms.

12. A process according to claim 8, wherein the antifoamant comprises sucrose distearate.

13. A process according to claim 8, wherein the antifoamant comprises a mixture of sucrose distearate and sucrose monostearate.

14. A process according to claim 1, wherein the aqueous dispersing medium comprises a gelatino-peptizer.

15. A process according to claim 14, wherein the antifoamant is added to the aqueous dispersing medium in the form of a small particle dispersion, wherein the particle size of the dispersion is from 0.02 to 100 $\mu$m, and wherein the concentration of the antifoamant in the dispersion is from 0.1% to 50% by weight of the total dispersion.

16. A process according to claim 15, wherein the small particle dispersion is prepared in the presence of gelatin, such that the gelatin concentration in the small particle antifoamant dispersion is from 1 to 25 weight percent.

17. A process according to claim 14, wherein the amount of antifoamant in the dispersing medium is from 1 ppm to 1% of the total weight of the emulsion that is made.

18. A process according to claim 14, wherein the amount of antifoamant in the dispersing medium is from 0.002% to 0.1% of the total weight of the emulsion that is made.

19. A process according to claim 14, wherein the gelatino-peptizer contains less than 30 $\mu$moles of methionine per gram of gelatin.

20. A silver halide photographic material comprising a support upon which is coated at least one light sensitive silver halide emulsion layer, comprising a silver halide emulsion precipitated in accordance with claim 1.

* * * * *